US012668752B2

(12) United States Patent
Koh et al.

(10) Patent No.: US 12,668,752 B2
(45) Date of Patent: Jun. 30, 2026

(54) APPARATUS FOR A REFORMED FUEL MANUFACTURING AND METHOD USING THE SAME

(71) Applicants: James Chun Koh, Fort Lee, NJ (US); Shinji Hasegawa, Tokyo (JP)

(72) Inventors: James Chun Koh, Fort Lee, NJ (US); Shinji Hasegawa, Tokyo (JP)

( * ) Notice: Subject to any disclaimer, the term of this patent is extended or adjusted under 35 U.S.C. 154(b) by 0 days.

(21) Appl. No.: 18/827,771

(22) Filed: Sep. 8, 2024

(65) Prior Publication Data

US 2026/0071132 A1 Mar. 12, 2026

(51) Int. Cl.
*C10L 1/32* (2006.01)

(52) U.S. Cl.
CPC ..... *C10L 1/328* (2013.01); *C10L 2270/026* (2013.01); *C10L 2290/146* (2013.01); *C10L 2290/24* (2013.01); *C10L 2290/38* (2013.01); *C10L 2290/547* (2013.01)

(58) Field of Classification Search
CPC ..... C10L 1/328; C10L 2270/026; C10L 2290/146; C10L 2290/24; C10L 2290/38; C10L 2290/547
See application file for complete search history.

(56) References Cited

U.S. PATENT DOCUMENTS

| | | | | |
|---|---|---|---|---|
| 7,670,987 | B2 * | 3/2010 | Kawashima | C01B 3/40 502/355 |
| 10,947,469 | B2 | 3/2021 | Koh | |
| 11,584,894 | B2 | 2/2023 | Koh | |
| 12,195,687 | B1 * | 1/2025 | Koh | C10L 1/328 |
| 2014/0223808 | A1 * | 8/2014 | Hasegawa | C10G 35/095 44/457 |
| 2014/0305028 | A1 * | 10/2014 | Koh | B01J 19/087 44/639 |
| 2015/0225659 | A1 * | 8/2015 | Koh | B01J 8/04 44/457 |

FOREIGN PATENT DOCUMENTS

| | | |
|---|---|---|
| KR | 101328151 B | 11/2013 |
| KR | 101581235 B | 12/2015 |

* cited by examiner

*Primary Examiner* — Cephia D Toomer
(74) *Attorney, Agent, or Firm* — LEEPI

(57) ABSTRACT

A reformed fuel manufacturing apparatus and method is provided, including a water treatment unit configured to pretreat a water introduced therein by using a carbon filter and a reverse osmosis purifier, an electrolysis tank unit connected to a reverse osmosis purifier and configured to additionally pretreat the water, an oil tank unit configured to store an oil introduced from an oil inlet, a mixed oil unit connected to the water treatment unit and the oil tank unit and configured to produce a mixed oil by using an inline mixer, and an ionization catalyst unit connected to the mixed oil unit and configured to convert the mixed oil to a reformed fuel; and a control unit configured to control all electronic and mechanical actuations of the reformed fuel manufacturing apparatus.

16 Claims, 9 Drawing Sheets

APPARATUS FOR A REFORMED FUEL MANUFACTURING AND METHOD USING THE SAME

FIELD OF THE INVENTION

The various embodiments described herein pertain generally to an apparatus for reformed fuel manufacturing from various types of oils and a method using the same.

BACKGROUND OF THE INVENTION

Recently, exhaustion of fossil fuel and generation of greenhouse gases have arisen as worldwide problems.

To solve the issue, Korean Patent No. 101328151 describes a method and apparatus for manufacturing an emersion fuel that exhibits high applicability. In this method and apparatus, water and oil fuel such as diesel, kerosene or heavy oil are supplied into a space to which a magnetic field is applied. In that space, the water and the oil fuel are atomized and mixed with each other, so that an emersion fuel is produced.

In such a conventional fuel manufacturing method and apparatus, however, since the fuel is in the form of emersion, water-oil separation may occur, and a water component may be left. Therefore, a flash point would be greatly increased, whereas calorific power would be decreased, resulting in a failure to reduce the consumption of the fossil fuel substantially.

To resolve the issues in the apparatus, the present inventor has filed and received a grant for Korean Patent No. 101581235 (titled "Apparatus for Manufacturing a Reformed Fuel and a Method for Manufacturing the Same"). In this method and apparatus, water is atomized by applying an ultrasonic wave, and hydrogen peroxide is decomposed by supply enzyme from an enzyme tank. Accordingly, water and oil are allowed to be easily mixed with each other without separation. Thus, it is possible to suppress the problems of the reformed fuel in the form of emersion, such as an increase of a flash point and a decrease of a calorific power.

However, its apparatus and method for manufacturing a reformed fuel involves a complicated process, and there is difficulty in managing enzyme in the enzyme tank. Further, since the apparatus has a complicated structure adapted to apply the ultrasonic wave and the electric field, manufacturing cost is high, and repair and maintenance of the apparatus is not easy. Also, in the process of producing and selling the actual system, there is a realistic problem that it is difficult to make a catalyst corresponding to the different additives added to the fuel in each country.

U.S. Pat. Nos. 10,947,469, 11,584,894 presented by the same inventor suggested a new methodology of manufacturing bio-emulsion fuel using vegetable oil. The oil from cashew nut husk is considered a waste but recently got new attention as a raw material for the reformed fuel due to its cost effectiveness.

The present invention represents the refinement of the apparatus in U.S. Pat. Nos. 10,947,469, 11,584,894 by modifying features in the manufacturing process compared to previously disclosed items. The newly added features result in increasing the effectiveness of the manufacturing process and enhancing the quality of bio-emulsion fuel as a final product.

SUMMARY

In view of the foregoing problems, the example embodiments provide an apparatus and method for manufacturing a reformed fuel using any types of oil containing different additives in each country.

In accordance with a first aspect of an illustrative embodiment, there is provided a reformed fuel manufacturing apparatus including a water treatment unit configured to pretreat a water introduced therein by using a carbon filter and a reverse osmosis purifier; an electrolysis tank unit connected to a reverse osmosis purifier and configured to additionally pretreat the water; an oil tank unit configured to store an oil introduced from an oil inlet; a mixed oil unit connected to the water treatment unit and the oil tank unit and configured to produce a mixed oil by using an inline mixer; an ionization catalyst unit connected to the mixed oil unit and configured to convert the mixed oil to a reformed fuel; and a control unit configured to control all electronic and mechanical actuations of the reformed fuel manufacturing apparatus.

In accordance with the first aspect of the illustrative embodiment, there is provided a reformed fuel manufacturing method including, preparing a pretreated water by a carbon filter and a reverse osmosis purifier located along an inlet of water supply; additionally pretreating the water by applying a hydrogen reduction catalyst, an electrolysis device, and a platinum catalyst; and, producing a mixed oil from the pretreated water and an oil with an inline mixer; converting the mixed oil from the mixed oil unit to a reformed fuel with an ionization catalyst group.

According to the above-mentioned problem-solving method of the present invention, the reformed fuel using various types of oils generates heat higher in combustion than that of the emulsion fuel by the conventional fossil fuel.

Also, the reformed fuel has reduced pollutant emission due to its characteristics of emulsion fuel.

BRIEF DESCRIPTION OF THE DRAWINGS

In the detailed description that follows, embodiments are described as illustrations only since various changes and modifications will become apparent from the following detailed description. The use of the same reference numbers in different figures indicates similar or identical items.

DETAILED DESCRIPTION

Figure 1:
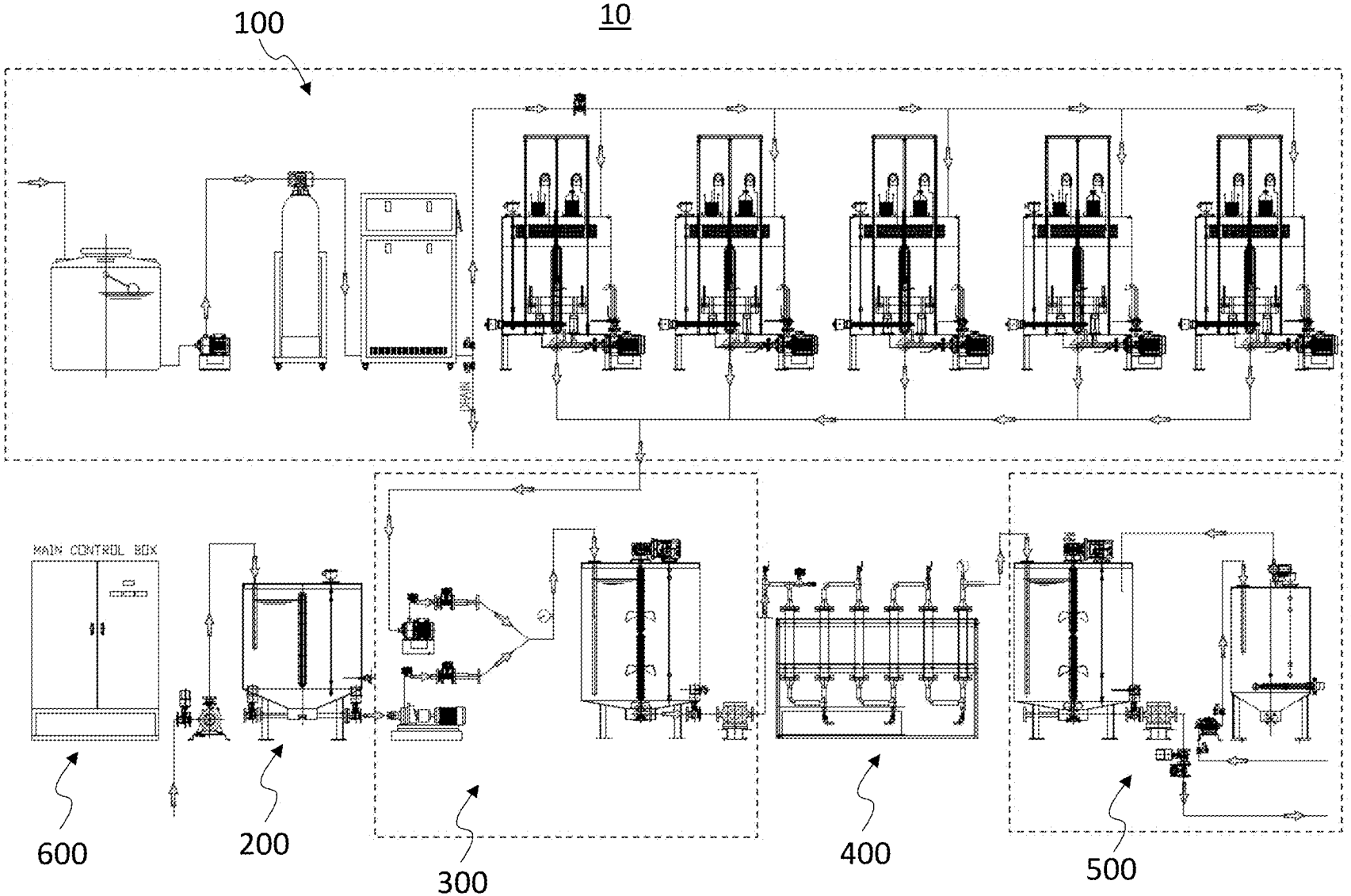
FIG. 1 is a process flowchart of a reformed fuel manufacturing apparatus in accordance with an example embodiment to explain how the reformed fuel is produced through the present invention.

Hereinafter, example embodiments will be described in detail so that inventive concept may be readily implemented by those skilled in the art. However, it is to be noted that the present disclosure is not limited to the illustrative embodiments and examples but can be realized in various other ways. In drawings, parts not directly relevant to the description are omitted to enhance the clarity of the drawings, and like reference numerals denote like parts through the whole document.

Through the whole document, the term "on" that is used to designate a position of one element with respect to another element includes both a case that the one element is adjacent to another element and a case that any other element exists between these two elements.

Through the whole document, the term "comprises or includes" and/or "comprising or including" used in the document means that one or more other components, steps, operation and/or existence or addition of elements are not excluded in addition to the described components, steps, operation and/or elements unless context dictates otherwise. The term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

Hereinafter, example embodiments will be described in detail with reference to the accompanying drawings, which form a part hereof.

First, a reformed fuel manufacturing apparatus 10 (hereinafter, referred to as "the present reformed fuel manufacturing apparatus 10") in accordance with an example embodiment will be elaborated.

Referring to FIG. 1, a configuration of the present reformed fuel manufacturing apparatus 10 will be explained. As depicted in FIG. 1, the present reformed fuel manufacturing apparatus 10 includes a water treatment unit 100, an oil tank unit 200, a mixed oil unit 300, an ionization catalyst unit 400, a post process unit 500, and a control unit 600. The dotted box in FIG. 1 encompasses the inclusion of several items in the unit if any unit has more than one item therein.

Figure 2:
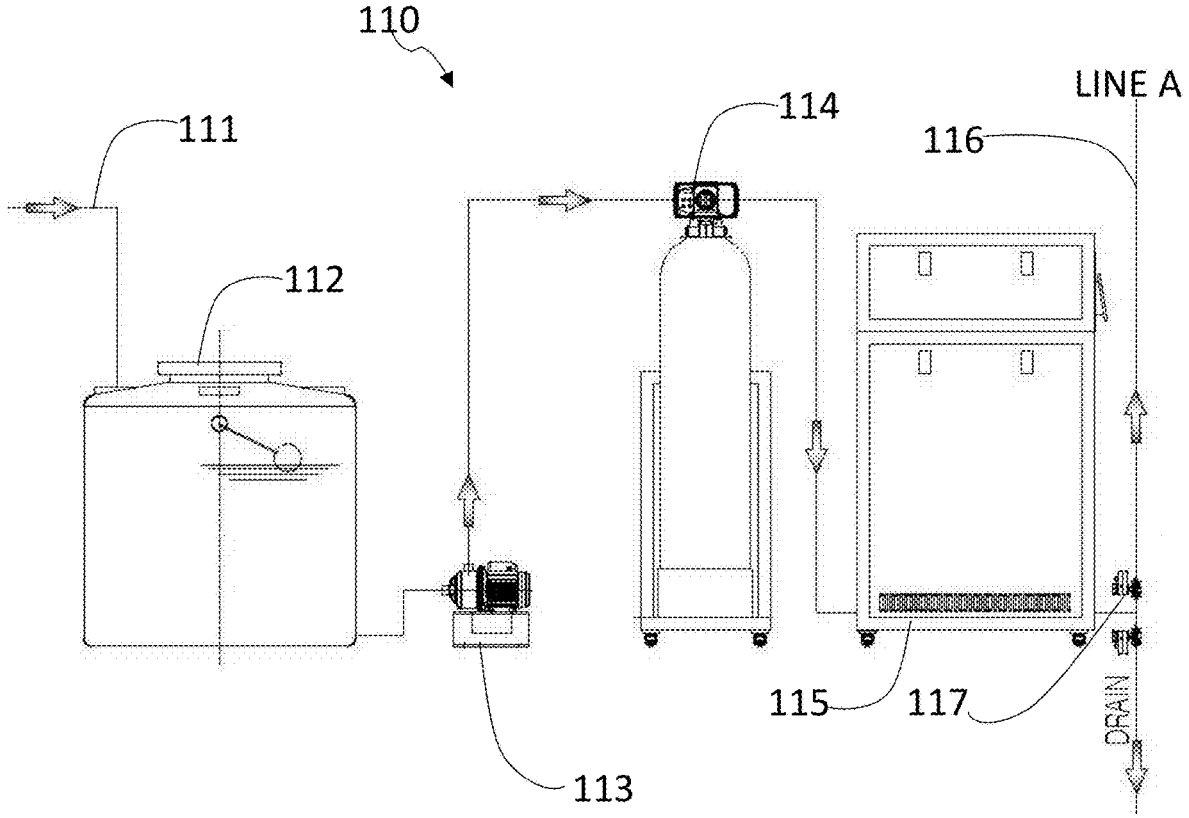
FIG. 2 is a schematic side view of a water pretreatment unit in accordance with the example embodiment.
Figure 3:
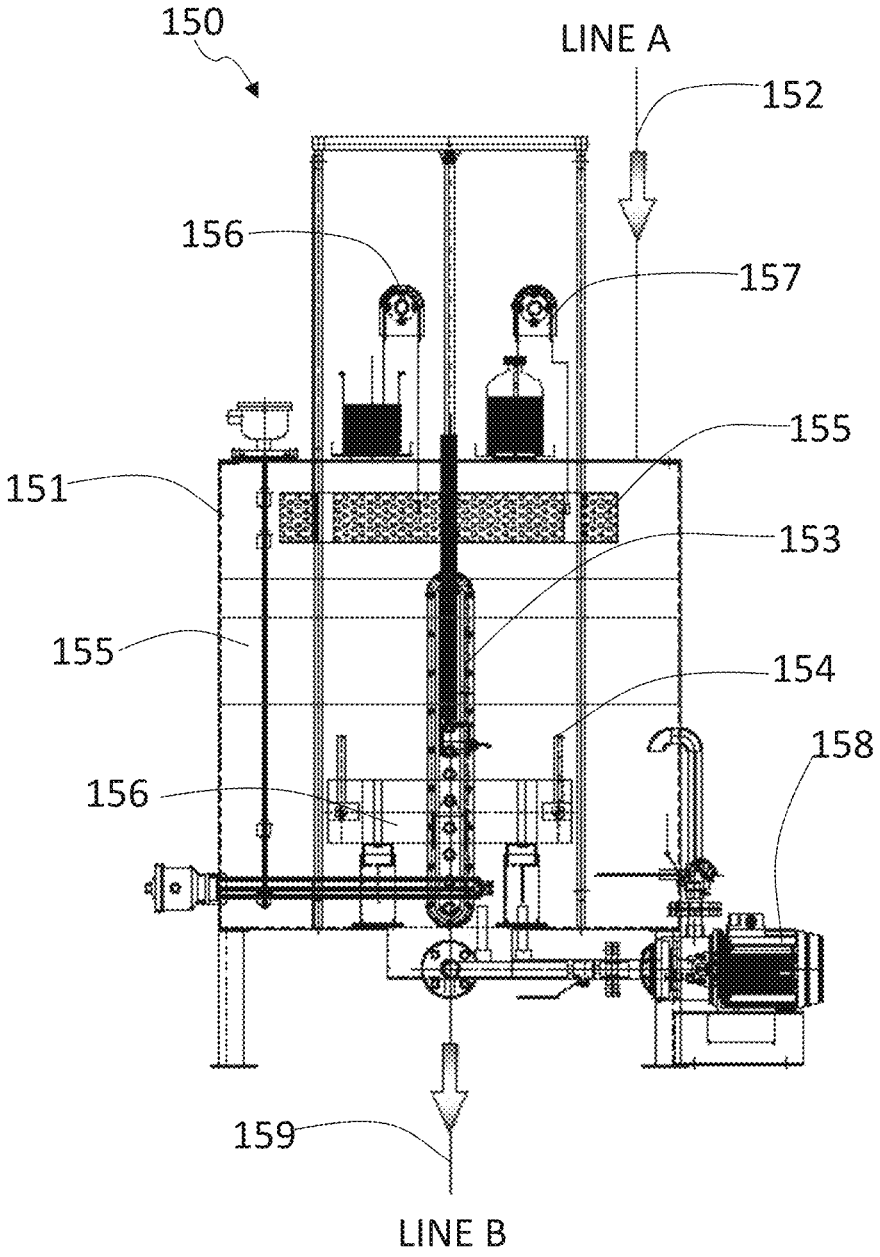
FIG. 3 is a schematic side view of an electrolysis tank unit in accordance with the example embodiment.

The water treatment unit 100 further includes a water pretreatment unit 110 shown in FIG. 2, and an electrolysis tank unit 150 shown in FIG. 3 accordingly.

In FIG. 2, the water pretreatment unit 110 is configured to pretreat a water introduced therein by a water inlet line 111. The water is temporally stored at a water tank 112 and then fed to a carbon filter 114 by a water feeding pump 113. The water then goes to a reverse osmosis purifier 115 installed along the carbon filter 114. The pretreated water is supplied to LINE A 116 connected to the electrolysis tank unit 150. The excessive water may be drained by a water control valve 117.

In FIG. 3, the electrolysis tank unit 150 is configured to generate the pretreated water to be ready for a next mixing process with oil by adjusting Oxidation Reduction Potential (ORP) and pH level thereof. The pretreated water is introduced to the electrolysis tank 151 from LINE A 152. The material of the electrolysis tank 151 may be a stainless steel (SUS 304) to prevent corrosion and should be wrapped with ceramic wool on the outside for insulation to prevent heat loss from surroundings. A trace heater 155 is wrapped around an outside surface of the electrolysis tank 151 to actively control the temperature of the pretreated water therein.

Multiple arrays of the electrolysis tank unit 150 may be installed as shown in FIG. 1, because the water treatment process takes longer time than oil preparation. To facilitate the reformed fuel manufacturing apparatus 10 continuously up and running, the number electrolysis tank unit 150 may be installed 4-5 times more than the oil tank unit 200.

A water electrolysis device 154 is installed inside the electrolysis tank 151. The DC power supply of the water electrolysis device is in range of 0-80V, 0-100A, output power to be 2,000 W, and is equipped with a communication is connected to the main control unit 600 (not shown in FIG. 3).

The electrolysis tank 151 further includes a water level window 153, water supply pump 158, and a water outlet line 159.

The water level window 153 is configured to measure a water amount, i.e., a water level within the electrolysis tank 151. The water level information obtained by the water level window 153 may be sent to the control unit 600. The control unit 600 adjusts the water level by checking the water level information and controlling operation of the water supply pump 158 to LINE B 159.

Two catalysts are used in the electrolysis tank unit 150. Firstly, a hydrogen reduction catalyst 155 is a ball shaped and installed inside the electrolysis tank 151. The hydrogen reduction catalyst is molded from a mixed composition of natural ores and metal minerals are produced through a low-temperature hot air drying process after a long heating treatment at a low heat of less than 120° C. to make it stable in terms of catalytic and activation functions.

In particular, the hydrogen reduction catalyst 155 is a functional material that not only maintains the amount of dissolved hydrogen and negative ORP continuously by strengthening the redox potential and generating hydroxide ions through hydrogen generation, but also changes it into a material with high antioxidant power.

Secondly, a platinum catalyst 156 is installed inside the electrolysis tank 151. During the water electrolysis process, the platinum catalyst 156 promotes the reaction that breaks down water into hydrogen and oxygen. Specifically, the platinum catalyst 156 facilitates, 1. the anodic reaction: Water molecules react with the platinum catalyst at the anode, breaking down into hydrogen ions ($H^+$) and electrons (e−), and 2. catalyzing the cathode reaction: At the cathode, oxygen molecules ($O_2$) react with the platinum catalyst to combine with hydrogen ions and electrons to form ($H_2O$).

A pH level adjuster 156 is installed on top of the electrolysis tank 151 configured to maintain pH level of the water inside the electrolysis tank 151 to be in the range of 6-6.5. The control unit 600 continuously monitors the pH level of the water and the feeding amount of the pH neutralizer inside the pH level adjuster 156 is determined accordingly.

Additionally, a urea water feeder 157 is installed on top of the electrolysis tank 151. Urea water is an ingredient that converts nitrogen oxides, a carcinogenic emission from diesel vehicles, into water and nitrogen to reduce the air pollution.

The process of electrolysis tank unit 150 is explained as follows. Firstly, the hydrogen reduction catalyst 155 is submerged into the water inside the electrolysis tank 151 for about 30 minutes until ORP is −300. Then, the hydrogen reduction catalyst 155 is taken out from the water, then the urea water feeder 157 adds 20 g of urea water per 750 L of the water. Then, electrolysis process is performed by using the electrolysis device 154 and the platinum catalyst 156 until ORP of the water becomes ~265 ~−275.

The technical background for the purpose of water pretreatment is explained as follows. Hydrogen is an alkane reduction of Cn H 2n+2, and the oxidation of $H_2O$. This is a technology that additives ($H_2O$) are added to alkanes by oxidizing added water (a molecule called $H_2O$), using the oxidized $H_2O$ as a reducing agent, and reducing an alkane fuel with about 10 to 20 carbon atoms (C). Alkanes are expressed to $CH_3$+ ($CH_2$+$CH_2$+ . . . +$CH_2$)+$CH_3$. For example, if cetane (C16H34=$CH_3$ ($CH_2$) 14$CH_3$ is reduced (in the chemical formula), then it becomes 2×octane ($C_8H_{18}$=$CH_3$ $(CH_2)_6CH_3$). This reaction does not occur naturally. The beauty of the presented apparatus is to enable reactions that do not normally occur. There are various methods for the redox reaction of water ($H_2O$), but the one adopted in this system is the electrolytic treatment method. So-called electrolysis.

Normally, when water ($H_2O$) is applied to the electrode, anode and cathode, an oxidation reaction occurs on the anode side and a reduction reaction occurs on the cathode side, and oxygen ($O_2$) is released from the anode to the cathode. It is already known that hydrogen ($H_2$) is generated from;

$$2H_2O + 2e^- = H_2 + 2OH^- \quad (0.41\ V)$$

This system makes the water of the additive an effective reducing agent by adjusting (reforming) the electrolyte (water) used by subjecting the electrode to special treatment. This system mixes the reducing agent, which has undergone transition in a very short time, to alkanes at a suitable pressure and flow rate (suitable contact time), and after mixing, passes through various types of catalysts at an appropriate pressure to stop the re-reaction of the mixed solution and the system is complete.

In conclusion, water ($H_2O$) is a molecule that creates molecular crystals with only a small number of them. In the impurities (components) of water (raw water), there are components that promote the reaction, components that hinder it, and components that retain it. The catalytic reaction is necessary for both water and mixed liquid.

In this system, the reduction of alkanes is a reduction reaction using water (raw water) as a raw material, modifying water, and subjecting an ion effect generated from a specially processed electrode to an electrolytic treatment liquid as a nucleophile.

A compound in which hydrogen on a carbon of a hydrocarbon other than the benzene ring of an alkane is substituted with a hydroxyl group is called alcohol, and a compound in which hydrogen in a benzene ring is substituted with a hydroxyl group is called phenol. In the water production (OH) hydroxy (hydroxy) is generated.

In this system, hydroxy and neutral radical (·OH); Hydroxycal is a component that greatly interferes with the reaction, but it is necessary to obtain a component supplementing this from raw water.

In general, a chemical substance added for the purpose of stopping a chain reaction or decomposition is called a scavenger, but it is excluded if the raw water contains a component obtained from raw water and interfering with it.

Since the reaction system occurs in a very short period and in a unique environment, it is essential to analyze the raw water components to remove interfering components, and to add deficient components that distinguish between buffering components and accelerating components.

| | NaBH4 | LiBH4 | LiAlH4 | BH3 |
|---|---|---|---|---|
| (aldehyde) | ◎ | ◎ | ◎ | ○ |
| (ketone) | ◎ | ◎ | ◎ | ○ |
| (ester) | ○ | ◎ | ◎ | ○ |
| (amides) | × | × | ◎ | ◎ |
| (Carboxylic acid) | × | × | ○ | ◎ |

◎: Reversible
○: Reversible slowly
×: Non-reversible

Validation of the pretreatment of water is done by the measurement of pH and ORP of the water after carbon filtering, reverse osmosis purification and electrolysis. The desired value of pH should be 6-6.5, and ORP be −265 ~−275 to confirm the water is pretreated.

Figure 4:
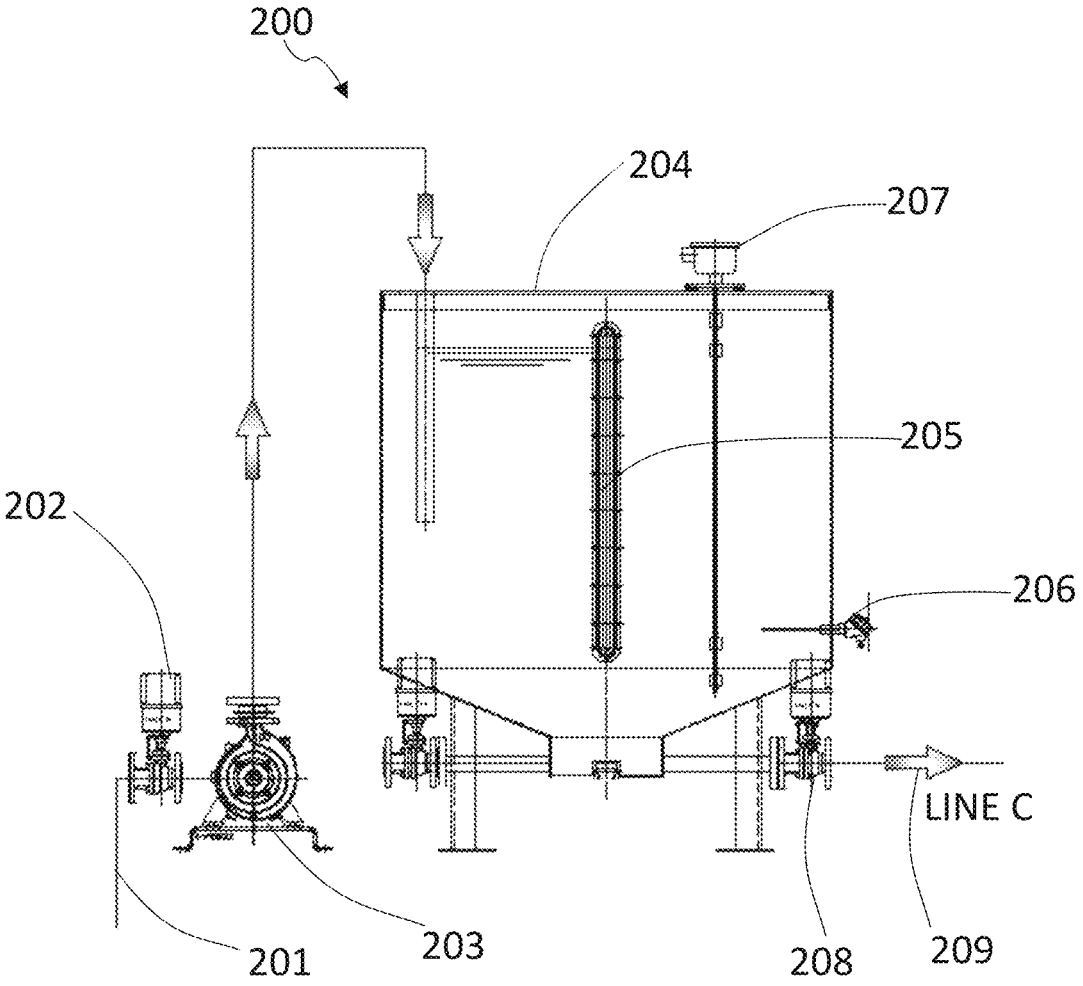
FIG. 4 is a schematic side view of an oil tank unit in accordance with the example embodiment.

In FIG. 4, the oil tank unit 200 is configured to store the oils introduced from an oil supply line 201.

The oil tank unit 200 further includes an oil inlet control valve 202, an oil supply pump 203, and an oil tank 204. The oil tank 204 further includes an oil level window 205, an oil heater 206, an air vent 207, and an oil outlet control valve 208.

The oil inlet line 201 delivers oil from an outside oil source into the oil tank 204 through the oil supply pump 203. The oil heater 206 may be submerged in the oil or a trace type that is wrapped around the outside surface of the oil tank 204 and provided to maintain an ideal temperature therein. By way of non-limiting example, the ideal oil temperature inside the oil tank 204 may be, e.g., about 50° C.

The oil level window 205 is configured to measure an oil level within the oil tank 204. The oil level information obtained by the oil level window 205 may be sent to the control unit 600 (not shown in FIG. 4). The control unit 600 adjusts the oil level within the oil tank 204 by checking the oil level information and controlling operation of the oil supply pump 203.

The air vent 207 is provided to prevent a pressure rise within the oil tank 204. The air vent 207 may be implemented by a pipe through which the air within the oil tank is exhausted.

An oil outlet line 209 delivers the oil into the mixed oil unit 300 to be described later. For example, the oil may be transferred into the oil outlet line LINE C 209 through an oil outlet control valve 208 provided at a lower portion of the oil tank 204.

The completion of the oil transfer may be determined by the control unit 600. Further, the control unit 600 may also control the opening and closing of the oil outlet control valve 208.

Figure 5:
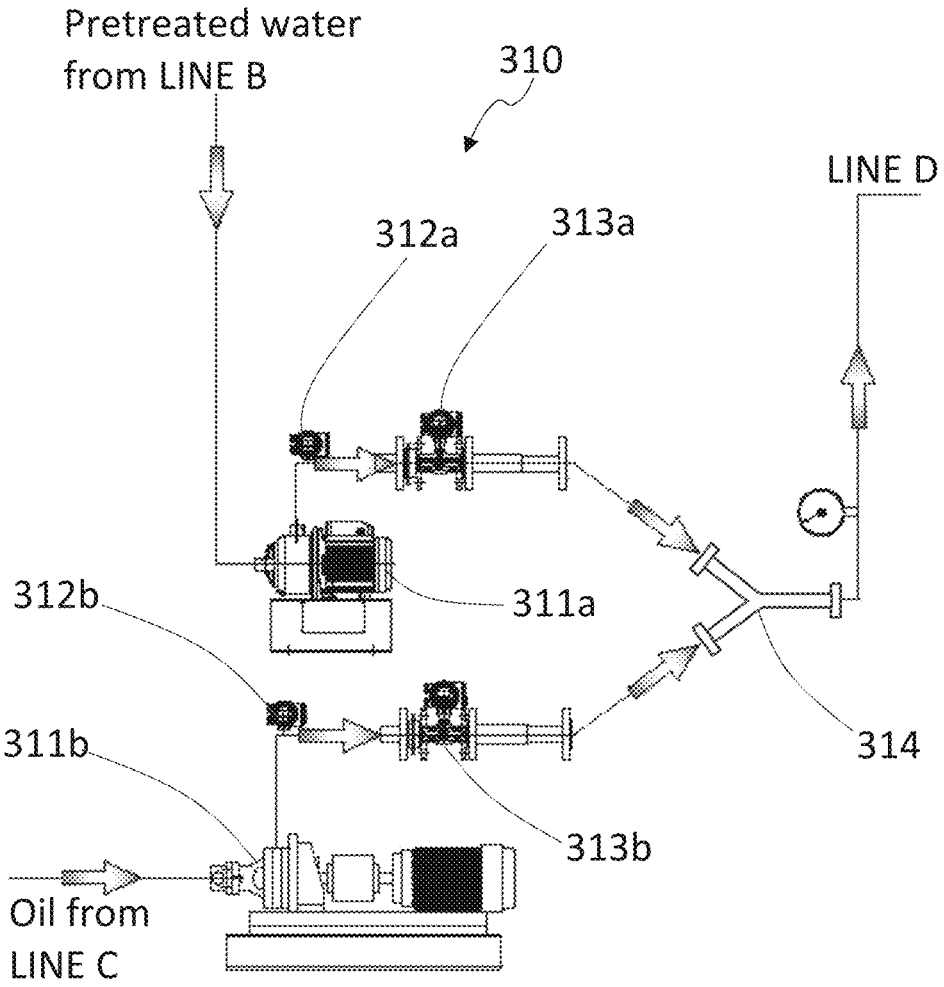
FIG. 5 is a schematic side view of an inline mixer unit in accordance with the example embodiment.
Figure 6:
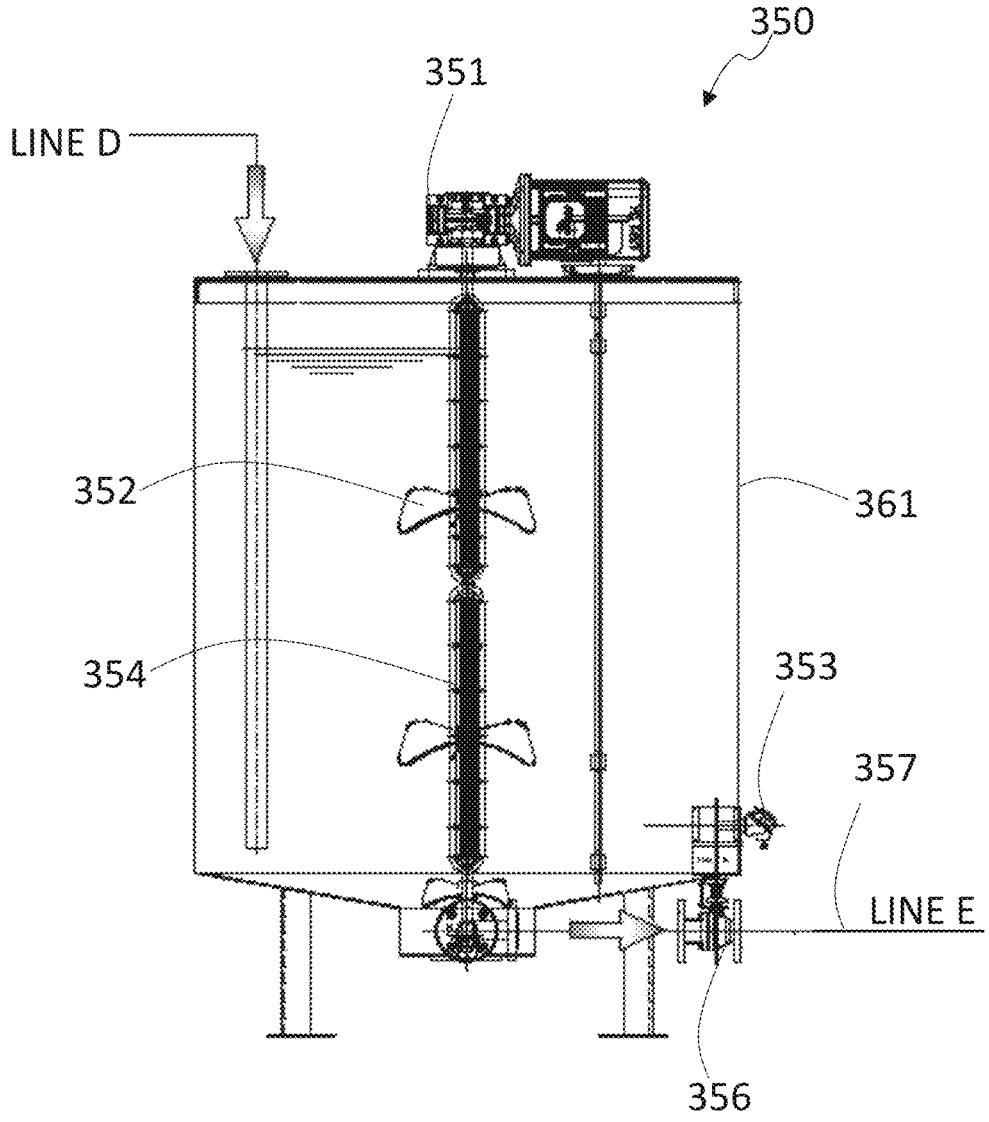
FIG. 6 is a schematic side view of a mixed oil tank unit in accordance with the example embodiment.

In FIG. 5 and FIG. 6, the mixed oil unit 300 is comprised of an inline mixer unit 310 and a mixed oil tank unit 350.

The inline mixer unit 310 in FIG. 5 is connected to the water treatment unit 100 by LINE B, and the oil tank unit 200 by LINE C respectively.

More specifically, the pretreated water from the water treatment unit 100 is transferred through LINE B to the inline mixer 314 by a high-pressure water pump 311*a*. Also, the oil from the oil tank unit 200 is transferred through LINE C to the inline mixer 314 simultaneously by a high-pressure oil pump 311*b*. Each conduit line between two units 100, 200 and the inline mixer 314 includes a control valve 312*a*, 312*b* configured to control the ratio of pretreated water and oil amount that goes into the inline mixer 314 respectively. The mixture ratio of the pretreated water and the oil is determined by the adjustment of the control valve 312*a*, 312*b* and the preferred ratio between the refined oil and the pretreated water may be set to 1:1 and may be 6:4 or 7:3 based on the operating condition. In addition, each conduit line between units 100, 200 and inline mixer 314 further includes a flow gage 313*a*, 313*b* to monitor the flow rate of each pretreated water and oil that go into the inline mixer 314. The data from the flow gage 313*a*, 313*b* are sent to the control unit 600 (not shown in FIG. 5) to automatically adjust the ratio in a precise way.

The inline mixer is equipped to effectively mix the pretreated water and the oil based on the following process. The pretreated water in the water treatment unit 100 is transferred to the inline mixer 314 in a pressurized way through the high-pressure water pump 311*a*. The amount of the pretreated water is determined by the control valve 312*a*. The pretreated water passes through the flow gage 313*a* installed along the conduit line between the water treatment unit 100 and the inline mixer 314.

The oil inside the oil tank unit 200 is transferred to the inline mixer 314 in a pressurized way through the high-pressure oil pump 311*b*. The amount of the oil is determined by the control valve 312*b*. The oil passes through the flow gage 313*b* installed along the conduit line between the oil tank unit 200 and the inline mixer 314.

The inline mixer 314 is formed to Y shape. That is, the conduit line from the water treatment unit 100 and the conduit line from the oil tank unit 200 is joined to the inline mixer 314 as a single line. The inline mixer 314 may have a multiple number of protrusions on an inner surface thereof, generating turbulence effect to the medium therein. The pretreated water and the oil that meet inside the inline mixer are physically mixed effectively while they pass through.

The mixed oil physically mixed by the inline mixer 314 is transferred to a mixed oil tank unit 350 through LINE D and temporarily stored therein, as shown in FIG. 6.

The mixed oil tank unit 350 further includes a mixed oil tank 361, an agitator motor 351, a mixed oil agitator 352, a mixed oil heater 353, a mixed oil level window 354, and a mixed oil outlet control valve 356.

The mixed oil agitator 352 is configured to agitate the mixed oil introduced into the mixed oil tank 361 such that physically mixed status is maintained effectively. By way of example, the mixed oil agitator 352 may include the agitator motor 351 at an upper portion thereof; and a blade configured to mix the oil and the water. The blade may be rotated at, but not limited to, about 250 rpm to mix the oil uniformly.

For example, the mixed oil may stay in the mixed oil tank 361 for about 5 minutes or less, during which the mixed oil may be more uniformly mixed by the agitating operation of the mixed oil agitator 352.

The mixed oil heater 353 may be configured to maintain a temperature of the mixed oil within a preset range to allow the constant temperature inside the mixed oil tank 361. The mixed oil heater 353 may be submerged in the oil or a trace type that is wrapped around the outside surface of the mixed oil tank 361 and provided to maintain an ideal temperature therein. Desirably, the temperature of the mixed oil may be maintained in the range from, e.g., about 25° C. to about 35° C.

The mixed oil level window 354 is configured to measure the level of the mixed oil. A measurement result of the mixed oil level window 354 is continuously monitored by the control unit 600 (not shown in FIG. 6). The control unit 600 may control an inflow and an outflow of the mixed oil based on this measurement result.

The ionization catalyst unit 400 is connected to the mixed oil unit 300. The ionization catalyst unit 400 is configured to generate a reformed fuel from the mixed oil by using a multiple array of ionization catalyst group.

Figure 7:
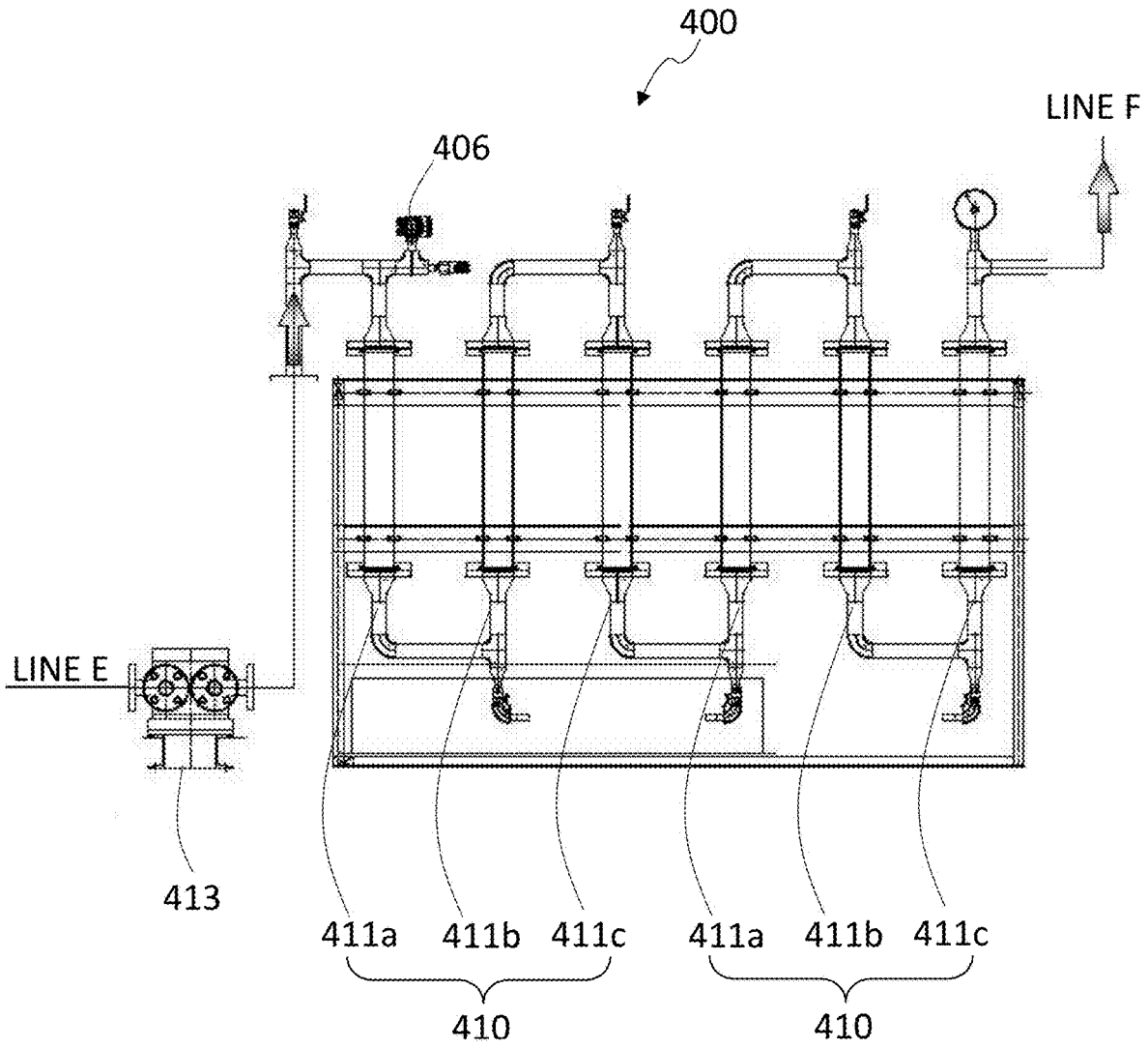
FIG. 7 is a schematic side view of an ionization catalyst unit with the example embodiment.

Referring to FIG. 7, the ionization catalyst unit 400 in accordance with the example embodiment will be described in detail.

A mixed oil supply pump 413 is configured to transfer the mixed oil in the mixed oil tank 361 to the ionization catalyst unit 400 through LINE E. The mixed oil supply pump 413 may be configured to supply a regular amount of mixed oil to the ionization catalyst unit 400 continuously. Further, the mixed oil supply pump 413 may be implemented by, but not limited to, a trochoid pump. The mixed oil pump feeds the mixed oil to the ionization catalyst groups at 10-12 $kgf/cm^2$ pressure.

The ionization catalyst unit 400 may include one or more ionization catalyst group 410, and each ionization catalyst group 410 may include a multiplicity of ionization catalyst cartridges 411.

In a configuration where a plurality of ionization catalyst groups 410 is provided, these ionization catalyst groups 410 may be connected to each other in series or in parallel to allow the mixed oil to pass through an ionization catalyst repeatedly. For example, the ionization catalyst groups 410 may be connected in series or in combination of in series and in parallel.

By way of example, referring to FIG. 7, four ionization catalyst cartridges 411 may be connected, two shown in FIG. 7 and two hidden located back side of shown arrays, in combination of in series and in parallel. To be more specific, four ionization catalyst groups 410, each of which has three ionization catalyst cartridges 411 may be provided.

As described above, as the plurality of ionization catalyst groups 410 are connected in series, the mixed oil is made to pass through the ionization catalyst groups 410 repeatedly by controlling an open-close control valve installed at the front of the ionization catalyst groups 410.

In this manner, the mixed oil can be converted to the reformed fuel with higher efficiency by passing through the ionization catalyst groups 410 multiple times.

Meanwhile, the ionization catalyst may include, but not limited to, alumina, silica gel, germanium, magnesia, magnesium, titanium oxide, Tomuro stone, zeolite, lithium ore and vanadium as main components. By way of example, the ionization catalyst cartridge 411 may be implemented in the form of a pipe charged with a spherical catalyst containing, but not limited to, alumina, silica gel, germanium, magnesia, magnesium, titanium oxide, Tomuro stone, zeolite, lithium ore and vanadium as main components. For example, a diameter of the spherical catalyst may be, e.g., about 1 cm.

The multiplicity of ionization catalyst cartridges 411 may be classified into three kinds depending on which catalyst material is added to the main components of the ionization catalyst.

That is, the multiplicity of ionization catalyst cartridges 411 incorporated in each ionization may include a first ionization catalyst cartridge 411*a*, a second ionization catalyst cartridge 411*b* and a third ionization catalyst cartridge 411*c*.

By way of example, referring to FIG. 7, the ionization catalyst unit 400 may be comprised of four ionization catalyst groups 410 connected in combination of in series and in parallel, and each ionization catalyst group 410 includes three ionization catalyst cartridges 411*a*, 411*b* and 411*c*.

The mixed oil may be allowed to pass through the ionization catalyst group 410 in the order of the first ionization catalyst cartridge 411*a*, the second ionization catalyst cartridge 411*b* and then the third ionization catalyst cartridge 411*c*.

By way of example, referring to FIG. 7, the mixed oil may pass through the ionization catalyst groups 410 four times. That is, after the mixed oil may pass through a first ionization catalyst cartridge 411*a*, a second ionization catalyst cartridge 411 and a third ionization catalyst cartridge 411*c* of a first ionization catalyst group 410 in sequence, the mixed oil may then be made to pass through a first ionization catalyst cartridge 411*a*, a second ionization catalyst cartridge 411 and a third ionization catalyst cartridge 411*c* of a second ionization catalyst group 410 in sequence.

Further, the first ionization catalyst cartridge 411*a* serves to cause ionization of carbons included in the oil in the mixed oil. Through the ionization, adsorption of hydrogen in the water and the carbon in the oil can be facilitated.

An ionization catalyst accommodated in the first ionization catalyst cartridge 411*a* may be prepared by adding copper ions, silver ions, carbon ions and tourmaline to basic catalyst materials including alumina, silica gel, germanium, magnesia, magnesium, titanium oxide, Tomuro stone, zeolite, lithium ore and vanadium, and then by ceramizing the mixture. The ionization catalysts included in the first ionization catalyst cartridge 411*a* may be referred to as an ionizing catalyst.

The second ionization catalyst cartridge 411*b* serves to couple carbon components included in the oil in the mixed oil and hydrogen components in the water in the mixed oil. For example, the carbon components included in the oil in the mixed oil may be carbons ionized while passing through the first ionization catalyst cartridge 411*a*. Further, the hydrogen components included in the water in the mixed oil may be hydrogen ionized as the water in the water tank is pretreated as stated above.

An ionization catalyst accommodated in the second ionization catalyst cartridge 411*a* may be prepared by adding hydrogen ions, carbon ions and active oxygen species to the basic catalyst materials including alumina, silica gel, germanium, magnesia, magnesium, titanium oxide, Tomuro stone, zeolite, lithium ore and vanadium, and then by ceramizing the mixture. The ionization catalysts included in the second ionization catalyst cartridge 411*b* may be referred to as a hydrogenating catalyst.

The third ionization catalyst cartridge 411*c* serves to stabilize the mixed oil having passed through the first and second ionization catalyst cartridges 411*a* and 411*b*.

To stabilize the mixed oil, the third ionization catalyst cartridge 411*c* may serve to coat a molecular structure of the mixed oil obtained while the mixed oil passes through the second ionization catalyst cartridge 411*b*, thus allowing that molecular structure to be maintained.

An ionization catalyst accommodated in the third ionization catalyst cartridge 411*c* may be prepared by adding titanium powder to the basic catalyst materials including alumina, silica gel, germanium, magnesia, magnesium, titanium oxide, Tomuro stone, zeolite, lithium ore and vanadium, and then by ceramizing the mixture. The ionization catalysts included in the third ionization catalyst cartridge 411*a* may be referred to as a coating catalyst.

Finally, the mixed oil is converted to the reformed fuel while it passes through the ionization catalyst unit 400 as described above.

Figure 8:
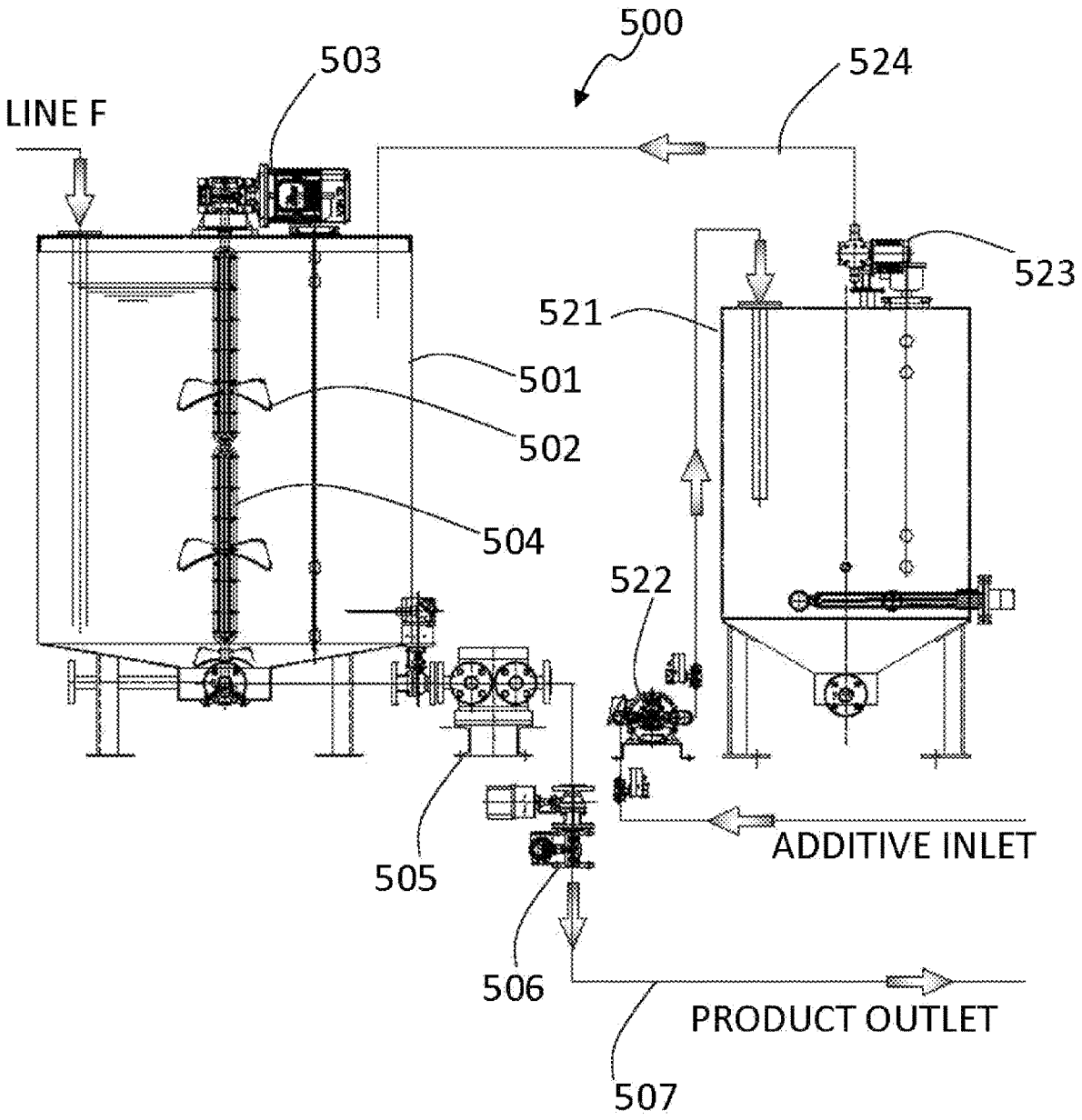
FIG. 8 is a schematic side view of a post process unit with the example embodiment; and, FIG. 9 is a flowchart describing the reformed fuel manufacturing method in accordance with the example embodiment.

Sometimes, the reformed fuel needs additives to maintain the stability of the fuel quality and the its original color. In FIG. 8, a post process unit 500 is optionally provides an additive to the reformed fuel if necessary and the detailed description is as follows.

The post process unit 500 is composed of a reformed fuel tank 501, a fuel agitator 502, a fuel agitator motor 503, and a fuel level window 504. The reformed fuel is stored at the reformed fuel tank 501 and the fuel agitator motor 503 rotates the fuel agitator 502 at 200~250 rpm to maintain the fuel uniformity. The fuel level window 504 monitors the level of the fuel inside the reformed fuel tank 501 and the control unit 600 (not shown in FIG. 8) controls the amount of the reformed fuel accordingly. An additive is a liquid type and inserted to an additive tank 521 by an additive supply motor 522. Based on the status of fuel inside the reformed fuel tank 501, the control unit 600 automatically determines how much of the additive would be applied and the amount of the additive is sent and mixed into the fuel through an additive supply line 524 and an additive feed pump 523.

The final product of the reformed fuel with enhanced stability and the colorization is sent to a product outlet 507 through a product supply pump 505 and a product supply valve 506.

Figure 9:
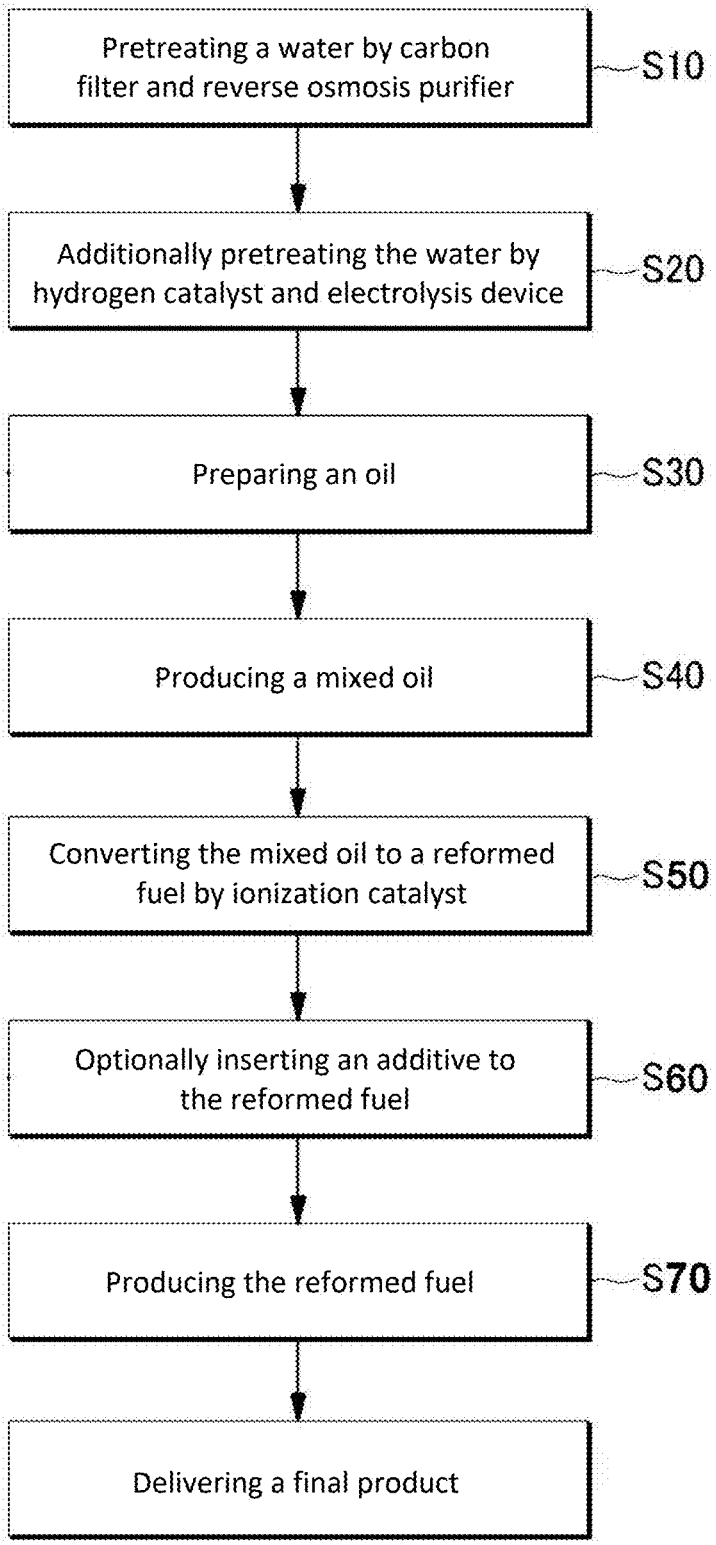

Now, by referring FIG. 9, a method for manufacturing a reformed fuel in accordance with the present example embodiment (hereinafter, simply referred to as "the present reformed fuel manufacturing method") will be elaborated. The present reformed fuel manufacturing method is directed to producing the reformed fuel by using the present reformed fuel manufacturing apparatus as described above. Parts identical or similar to those described in the present reformed fuel manufacturing apparatus will be assigned the same reference numerals, and redundant description will be simplified or omitted.

The present reformed fuel manufacturing method includes block S10 for pretreating a water by a carbon filter and a reverse osmosis purifier equipped along an inlet of water supply line in a water treatment unit 100.

The present reformed fuel manufacturing method further includes block S20 for additionally pretreating the water by a hydrogen reduction catalyst, a electrolysis device, and a platinum catalyst located inside a electrolysis tank.

The present reformed fuel manufacturing method further includes block S30 for preparing an oil by introducing the oil into an oil tank unit 200.

Further, the present reformed fuel manufacturing method includes block S40 for producing a mixed oil from the pretreated water introduced from the water treatment unit 100 and the oil introduced from the oil tank unit 200 with an inline mixer supplied into a mixed oil unit 300.

Within the mixed oil unit 300, the pretreated water and the oil are further mixed with each other by being agitated in a mixed oil tank. Accordingly, the mixed oil can be uniformly maintained without being separated.

Further, the present reformed fuel manufacturing method further includes a block S50 for converting the mixed oil from the mixed oil unit 300 to a reformed fuel with an ionization catalyst supplied into an ionization catalyst unit 400.

As stated above, the ionization catalyst may be accommodated in the ionization catalyst unit 400. The ionization catalyst unit 400 may include one or more ionization catalyst groups 410, and each ionization catalyst group 410 may include the multiplicity of ionization catalyst cartridges 411. Since the ionization catalyst and the configuration/operation of the ionization catalyst unit 400 are already discussed in the description of the present reformed fuel manufacturing apparatus, detailed description thereof will be omitted.

Optionally, the present reformed fuel manufacturing method includes a block S60 for inserting an additive to the reformed fuel to maintain fuel uniformity and prevent discoloration with a post process unit 500, then producing a final version of the reformed fuel depicted as a block S70.

The above description of the illustrative embodiments is provided for the purpose of illustration, and it would be understood by those skilled in the art that various changes and modifications may be made without changing technical conception and essential features of the illustrative embodiments. Thus, the above-described illustrative embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the illustrative embodiments. It shall be understood that all modifications and embodiments conceived from the meaning and scope of the claims and their equivalents are included in the scope of the inventive concept.

What is claimed is:

1. A reformed fuel manufacturing apparatus, comprising:

a water pretreatment unit configured to pretreat a water introduced therein by using a carbon filter and a reverse osmosis purifier;

an electrolysis tank unit connected to a reverse osmosis purifier and configured to additionally pretreat the water;

an oil tank unit configured to store an oil introduced from an oil inlet;

a mixed oil unit connected to the water treatment unit and the oil tank unit and configured to produce a mixed oil by using an inline mixer unit and store the mixed oil at a mixed oil tank;

an ionization catalyst unit connected to the mixed oil unit and configured to convert the mixed oil to a reformed fuel; and, a control unit configured to control all electronics and mechanical actuations of the reformed fuel manufacturing apparatus, wherein the electrolysis tank unit further comprises:

an electrolysis tank configured to receive the water from the reverse osmosis purifier;

a hydrogen reduction catalyst installed inside the electrolysis tank and configured to change oxidation reduction potential of the water inside the electrolysis tank;

an electrolysis device installed inside the electrolysis tank and configured to electrolyze the water inside the electrolysis tank; and, a platinum catalyst installed inside the electrolysis tank and configured to facilitate the electrolysis process of the water.

2. The reformed fuel manufacturing apparatus of claim 1, wherein the hydrogen reduction catalyst is firstly submerged in the water inside the electrolysis tank;

wherein the hydrogen reduction catalyst is then taken out from the water; and, wherein the water is subsequently electrolyzed thereafter by the electrolysis device and the platinum catalyst.

3. The reformed fuel manufacturing apparatus of claim 2, wherein the hydrogen reduction catalyst is submerged in the water until oxidation reduction potential of the water to be −300; and, wherein the water is electrolyzed by the electrolysis device and the platinum catalyst until oxidation reduction potential of the water to be in the range of −265~−275.

4. The reformed fuel manufacturing apparatus of claim 2, wherein the electrolysis tank unit further comprises:

a pH level adjuster configured to introduce a pH neutralizer into the electrolysis tank; and, a urea water feeder configured to introduce a urea water into the electrolysis tank;

wherein pH value of the water inside the electrolysis tank is in the range of 6.0-6.5.

5. The reformed fuel manufacturing apparatus of claim 1, wherein the oil tank unit further comprises:

an oil supply pump configured to introduce an oil therein; and, an oil tank configured to receive the oil through the oil supply pump and store the oil temporarily.

6. The reformed fuel manufacturing apparatus of claim 1, wherein the inline mixer unit further comprises:

a high-pressure water pump configured to transfer the pretreated water introduced from the electrolysis tank unit;

a high-pressure oil pump configured to transfer the oil introduced from the oil tank unit;

an inline mixer formed to Y shape and configured to receive the pretreated water through the high-pressure water pump and the oil through the high-pressure oil pump and generate the mixed oil; and, a mixed oil tank configured to receive and store the mixed oil from the inline mixer.

7. The reformed fuel manufacturing apparatus of claim 6, wherein, the pretreated water passes through a control valve configured to adjust the amount of the pretreated water flow, and a flow gage configured to measure a flow rate therein, all of which are installed along a conduit line between the electrolysis tank unit and the inline mixer; and, wherein, the oil passes through a control valve configured to adjust the amount of the oil flow, and a flow gage configured to measure a flow rate therein, all of which are installed along a conduit line between the oil tank and the inline mixer.

8. The reformed fuel manufacturing apparatus of claim 6, wherein, the inline mixer contains a multiple number of protrusions on an inner surface to produce turbulence to the pretreated water introduced from the electrolysis tank unit and the oil introduced from the oil tank unit.

9. The reformed fuel manufacturing apparatus of claim 7, wherein, the control unit adjusts a ratio between the pretreated water and the oil based on measurements of the flow rate from the flow gage respectively.

10. The reformed fuel manufacturing apparatus of claim 1, wherein the ionization catalyst unit further comprises:

a mixed oil pump configured to transfer the mixed oil to the ionization catalyst unit; and, one or more ionization catalyst groups configured to receive the mixed oil through the mixed oil pump;

wherein each of the one or more ionization catalyst group comprises a plurality of ionization catalyst cartridges; and, wherein each ionization catalyst cartridge accommodates therein an ionization catalyst.

11. The reformed fuel manufacturing apparatus of claim 10, wherein, the ionization catalyst groups are connected to each other in series or in combination of in series and in parallel for allowing the mixed oil to pass therethrough in sequence, and the number of catalyst groups are selected by an open-close control valve installed at the front of each ionization catalyst group.

12. The reformed fuel manufacturing apparatus of claim 11, wherein each of the plurality of ionization catalyst cartridges comprises:

a first ionization catalyst cartridge configured to cause ionization of carbon contained in the oil in the mixed oil;

a second ionization catalyst cartridge configured to cause a carbon component contained in the oil in the mixed oil to be coupled to a hydrogen component contained in the water in the mixed oil; and, a third ionization catalyst cartridge configured to stabilize the mixed oil having passed through the first ionization catalyst cartridge and the second ionization catalyst cartridge.

13. The reformed fuel manufacturing apparatus of claim 12, wherein the mixed oil is allowed to pass through the first ionization catalyst cartridge, the second ionization catalyst cartridge and the third ionization catalyst cartridge in sequence.

14. The reformed fuel manufacturing apparatus of claim 13, wherein the ionization catalyst contains alumina, silica gel, germanium, magnesia, magnesium, titanium oxide, Tomuro stone, zeolite, lithium ore and vanadium as basic catalyst materials.

15. The reformed fuel manufacturing apparatus of claim 10, wherein the mixed oil pump feeds the mixed oil to the ionization catalyst groups at 10~12 $kgf/cm^2$ pressure.

16. The reformed fuel manufacturing apparatus of claim 1 further includes, a post process unit optionally connected to the ionization catalyst unit and configured to insert an additive to the reformed fuel to maintain fuel uniformity and prevent discoloration.

* * * * *